US010858966B2

(12) United States Patent
Ogura et al.

(10) Patent No.: US 10,858,966 B2
(45) Date of Patent: Dec. 8, 2020

(54) VALVE TIMING CHANGE DEVICE

(71) Applicant: MIKUNI CORPORATION, Tokyo (JP)

(72) Inventors: Takahiro Ogura, Kanagawa (JP); Chikara Oikawa, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 331 days.

(21) Appl. No.: 15/781,476

(22) PCT Filed: Dec. 26, 2016

(86) PCT No.: PCT/JP2016/088626

§ 371 (c)(1),
(2) Date: Jun. 5, 2018

(87) PCT Pub. No.: WO2017/115739

PCT Pub. Date: Jul. 6, 2017

(65) Prior Publication Data

US 2020/0263573 A1 Aug. 20, 2020

(30) Foreign Application Priority Data

Dec. 28, 2015 (JP) ..... 2015-255774

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34423* (2013.01);
(Continued)

(58) Field of Classification Search
None
See application file for complete search history.

(56) References Cited

U.S. PATENT DOCUMENTS 8,505,507 B2 8/2013 Nakamura et al.
8,851,034 B2 10/2014 Boese et al.
(Continued)

FOREIGN PATENT DOCUMENTS

CN 102278159 12/2011
CN 102400728 4/2012
(Continued)

OTHER PUBLICATIONS

International Search Report (Form PCT/ISA/210) of PCT/JP2016/088626, dated Feb. 7, 2017, with English translation thereof, pp. 1-4.
(Continued)

*Primary Examiner* — Patrick Hamo
*Assistant Examiner* — Wesley G Harris
(74) *Attorney, Agent, or Firm* — JCIPRNET

(57) ABSTRACT

A valve timing change device includes: a housing rotor (10); a vane rotor; a fastening bolt (40) for fastening the vane rotor to a cam shaft; and an advance angle oil passage that constitutes a ring-shaped groove communicating with an advance angle chamber and a delay angle oil passage that constitutes a ring-shaped groove communicating with a delay angle chamber, via oil passages which are open at intervals on an outer circumferential surface of the fastening bolt. The vane rotor includes: a rotor body (20) having a small-diameter inner circumferential portion (23) and a large-diameter inner circumferential portion (24); and a rotor sleeve (30) that is fitted into the large-diameter inner circumferential portion, is in tight contact with the outer circumferential surface (41*a*) of the fastening bolt, and demarcates the advance angle oil passage (23*a*) in cooperation with the small-diameter inner circumferential portion.

8 Claims, 16 Drawing Sheets

(52) U.S. Cl.
CPC ..... *F01L 2001/34426* (2013.01); *F01L 2001/34433* (2013.01); *F01L 2001/34483* (2013.01)

(56) References Cited

U.S. PATENT DOCUMENTS

| | | | | |
|---|---|---|---|---|
| 10,113,450 | B2 * | 10/2018 | Suganuma | F01L 1/3442 |
| 2002/0062803 | A1 * | 5/2002 | Sato | F01L 1/022 123/90.17 |
| 2005/0056249 | A1 * | 3/2005 | Heinze | F01L 1/3442 123/294 |
| 2010/0313835 | A1 * | 12/2010 | Yamaguchi | F01L 1/3442 123/90.15 |
| 2011/0303169 | A1 * | 12/2011 | Nakamura | F01L 1/3442 123/90.15 |
| 2016/0010516 | A1 * | 1/2016 | Suzuki | F01L 1/3442 123/90.12 |
| 2017/0002749 | A1 * | 1/2017 | Sakakibara | F01L 1/3442 |

FOREIGN PATENT DOCUMENTS

| | | |
|---|---|---|
| DE | 102012209534 | 12/2013 |
| EP | 2843201 | 3/2015 |
| JP | 2011-140929 | 7/2011 |
| JP | 2011-256786 | 12/2011 |
| JP | 2012-057578 | 3/2012 |
| JP | 2012-193731 | 10/2012 |

OTHER PUBLICATIONS

"Office Action of China Counterpart Application," with English translation thereof, dated Oct. 9, 2019, p. 1-p. 14.
"Search Report of Europe Counterpart Application", dated Jul. 12, 2019, pp. 1-7.

* cited by examiner

VALVE TIMING CHANGE DEVICE

CROSS-REFERENCE TO RELATED APPLICATION

This application is a 371 application of the international PCT application serial no. PCT/JP2016/088626, filed on Dec. 26, 2016, which claims the priority benefit of Japan application no. 2015-255774, filed on Dec. 28, 2015. The entirety of each of the abovementioned patent applications is hereby incorporated by reference herein and made a part of this specification.

TECHNICAL FIELD

The present invention relates to a valve timing change device which changes an opening/closing time (valve timing) of an intake valve or an exhaust valve of an internal combustion engine in accordance with operation conditions.

BACKGROUND ART

As valve timing change devices in the related art, a valve timing change device including a case and a cam sprocket (a housing rotor) that are synchronized with a crank shaft and rotate on an axis of a cam shaft; a movable member (a vane rotor) that demarcates an advance angle chamber and a delay angle chamber in cooperation with the case and rotates on the axis; a bolt that fastens the movable member to the cam shaft and has an oil passage (a port); a flow rate control valve that is constituted of a sleeve which is fitted into a thinned insertion portion to pass the center of the bolt and has an oil passage (a penetration portion), and a spool which is inserted into the sleeve to be freely reciprocating and opens and closes the oil passages (the port and the penetration portion), and the like; an advance angle oil passage and a delay angle oil passage that constitute ring-shaped grooves formed on an inner circumferential surface of the movable member in which an outer circumferential surface of the bolt is fitted; and the like is known (for example, refer to Patent Literature 1 and the like).

In this device, the quantity of oil guided in and guided out with respect to the advance angle chamber and the delay angle chamber respectively via the advance angle oil passage and the delay angle oil passage is adjusted by suitably controlling driving of the flow rate control valve.

Here, the sleeve is formed of a material having a thermal expansion coefficient greater than that of the bolt so as to prevent oil leakage or the like from a gap generated due to thermal expansion in a fitting interface between the sleeve and the bolt of the flow rate control valve.

However, there is no mention of a gap in the fitting interface between the bolt and the movable member. If the bolt is formed of an iron-based material and the movable member is formed of an aluminum-based material, a gap is generated in the fitting interface due to a difference in thermal expansion between both thereof, or the like.

As a result, there is concern that the advance angle oil passage and the delay angle oil passage individually formed as the ring-shaped grooves on the inner circumferential surface of the movable member will communicate with each other and oil will not be able to be guided to the desired oil passage.

In addition, the advance angle oil passage and the delay angle oil passage constituting the ring-shaped grooves provided on the inner circumferential surface of the movable member are generally formed by performing boring in which the movable member is fed in an axis direction and a radial direction using a boring machine or the like. Therefore, the processing with the configuration described above is troublesome compared to boring or counter-boring in which the movable member is simply fed in only the axis direction and a cylindrical surface is formed.

CITATION LIST

Patent Literature

[Patent Literature 1]
Japanese Unexamined Patent Application Publication No. 2011-256786

SUMMARY OF INVENTION

Technical Problem

The present invention has been made to solve the problems of the technologies in the related art and to provide a valve timing change device which can realize a simplified manufacturing step and the like by reducing workloads in boring or the like.

Solution to Problem

According to the present invention, there is provided a valve timing change device which changes an opening/closing timing of an intake valve or an exhaust valve driven by a cam shaft. The valve timing change device includes a housing rotor that rotates on an axis of the cam shaft; a vane rotor that demarcates an advance angle chamber and a delay angle chamber in cooperation with the housing rotor and rotates on the axis; a fastening bolt that fastens the vane rotor such that the vane rotor rotates integrally with the cam shaft, and has oil passages; and an advance angle oil passage that constitutes a ring-shaped groove communicating with the advance angle chamber and a delay angle oil passage that constitutes a ring-shaped groove communicating with the delay angle chamber, via the oil passages which are open at intervals on an outer circumferential surface of the fastening bolt. The vane rotor is configured to include a rotor body which has a small-diameter inner circumferential portion coming into tight contact with the outer circumferential surface of the fastening bolt, and a large-diameter inner circumferential portion being formed to have a larger diameter than the small-diameter inner circumferential portion; and a rotor sleeve which is not in contact with the cam shaft, is fitted into the large-diameter inner circumferential portion, is in tight contact with the outer circumferential surface of the fastening bolt, and demarcates one of the advance angle oil passage and the delay angle oil passage in cooperation with the small-diameter inner circumferential portion.

In the configuration described above, the rotor sleeve may be configured to include a ring-shaped end surface which demarcates one of the advance angle oil passage and the delay angle oil passage in cooperation with the small-diameter inner circumferential portion, and a tubular portion which is press-fitted into the large-diameter inner circumferential portion and demarcates the other of the advance angle oil passage and the delay angle oil passage.

In the configuration described above, the tubular portion of the rotor sleeve may be configured to be formed to be divided into two parts, which demarcate the other of the advance angle oil passage and the delay angle oil passage in cooperation with each other.

In the configuration described above, the rotor sleeve may be configured to include a flange portion which abuts on an opening end surface of the large-diameter inner circumferential portion and is pressed in an axis direction by the fastening bolt.

In the configuration described above, the valve timing change device may be configured to further include an urging spring that rotatively urges the vane rotor in one direction about the axis with respect to the housing rotor. The rotor sleeve may be configured to have a hooking portion in the flange portion in which one end portion of the urging spring is hooked.

In the configuration described above, a ring-shaped recess portion or a ring-shaped clearance portion may be configured to be formed on an outer circumferential surface in the tubular portion of the rotor sleeve.

In the configuration described above, the rotor sleeve and the rotor body may be configured to be subjected to positioning by a common positioning portion which performs positioning of an angular position about the axis with respect to the cam shaft.

Advantageous Effects of Invention

According to the valve timing change device constituting the configuration described above, it is possible to solve the problems of the technologies in the related art and to achieve a simplified manufacturing step and the like by reducing workloads in boring or the like.

DESCRIPTION OF EMBODIMENTS

Figure 1:
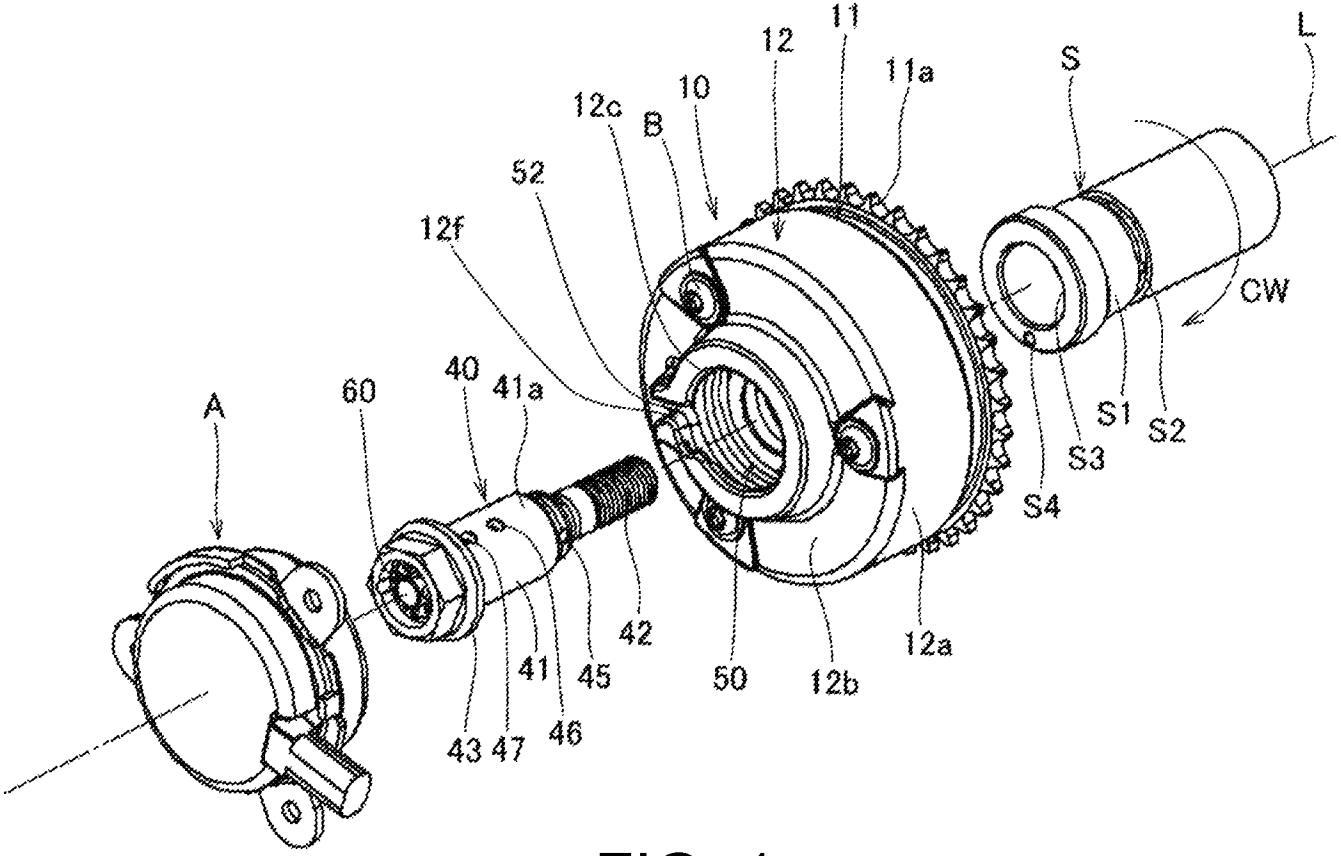
FIG. 1 is an exploded perspective view illustrating a valve timing change device, a cam shaft, and an electromagnetic actuator of the present invention.
Figure 2:
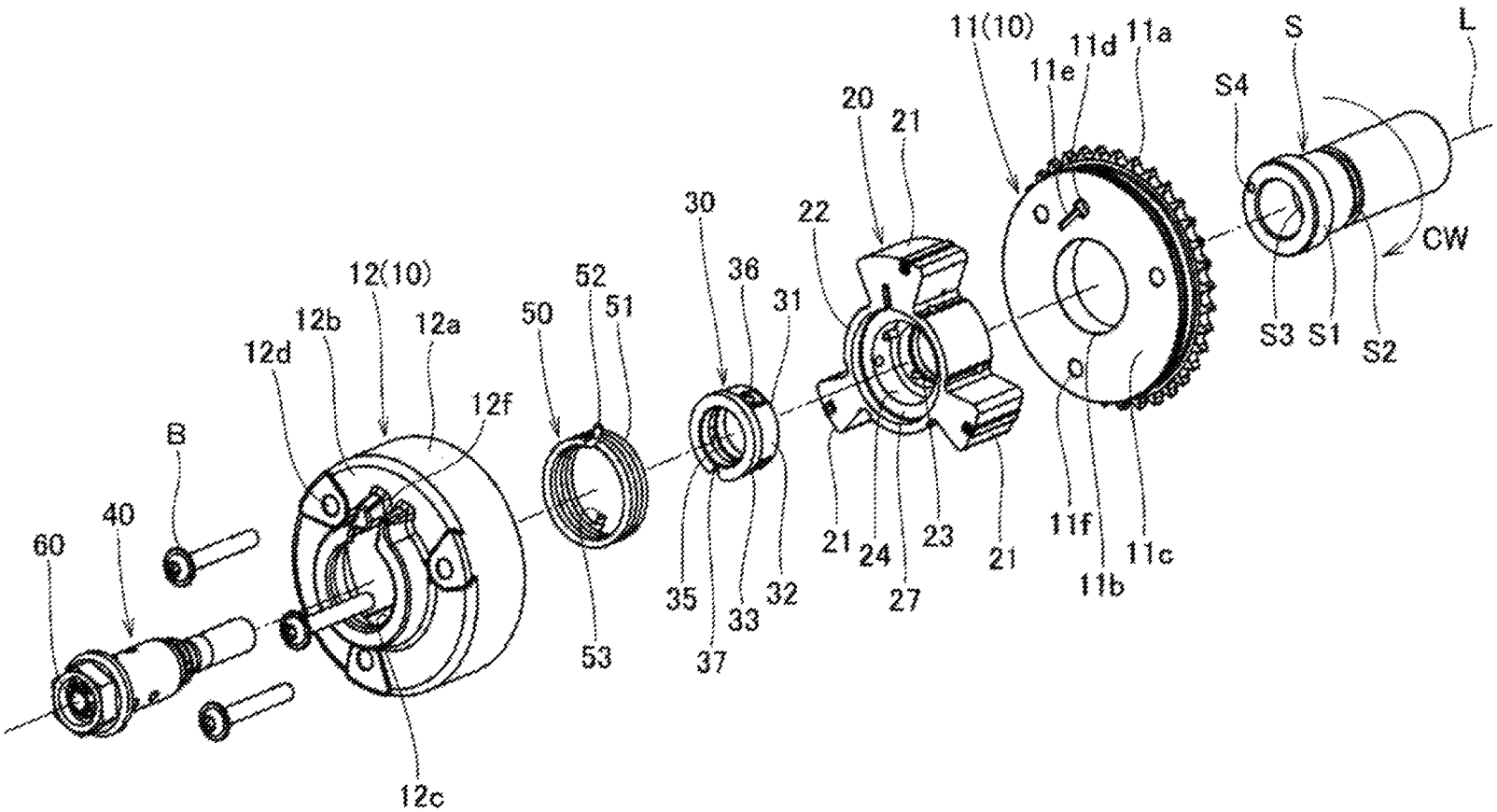
FIG. 2 is an exploded perspective view illustrating the valve timing change device of the present invention.
Figure 3:
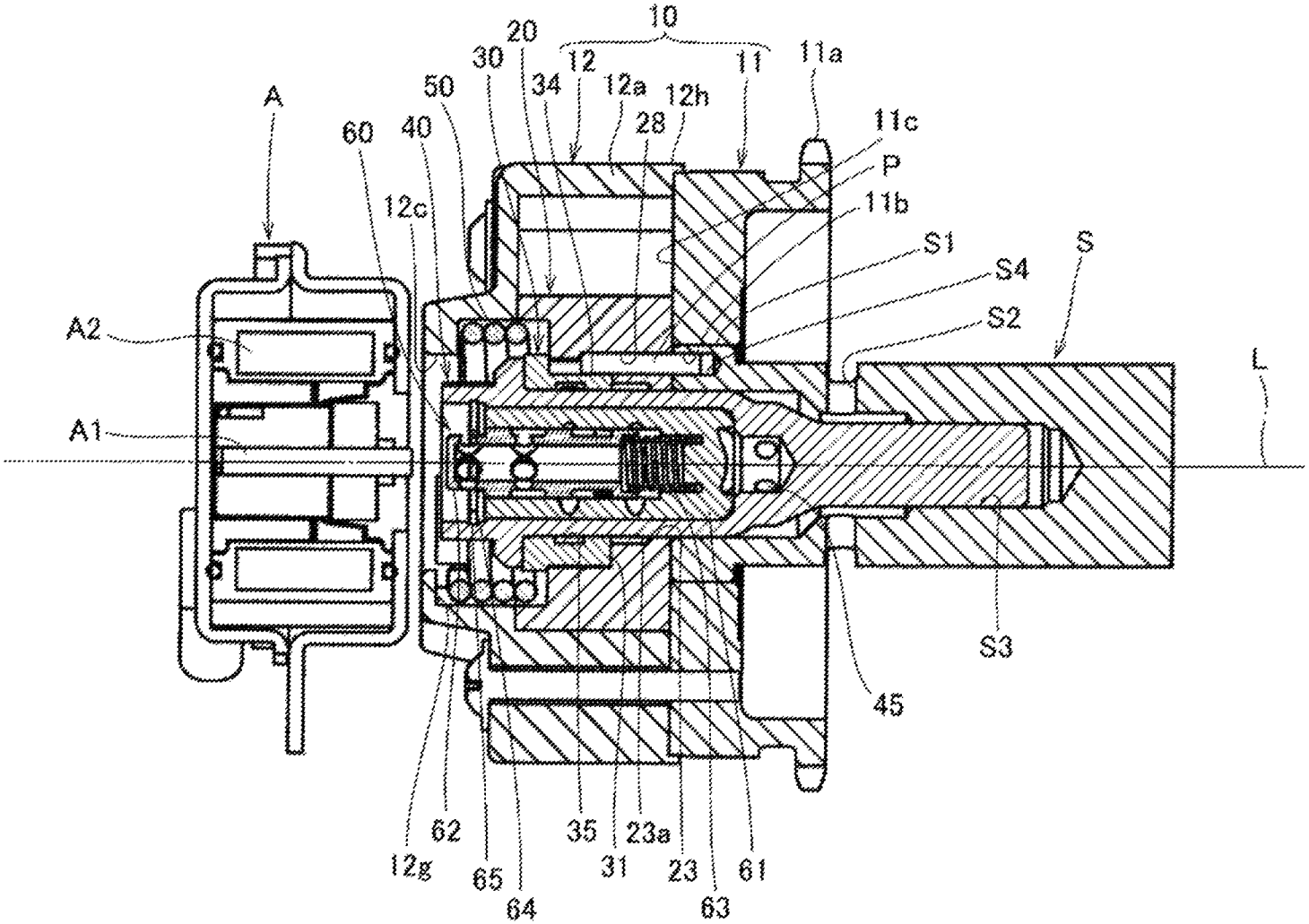
FIG. 3 is a sectional view illustrating the valve timing change device, the cam shaft, and the electromagnetic actuator of the present invention.
Figure 4:
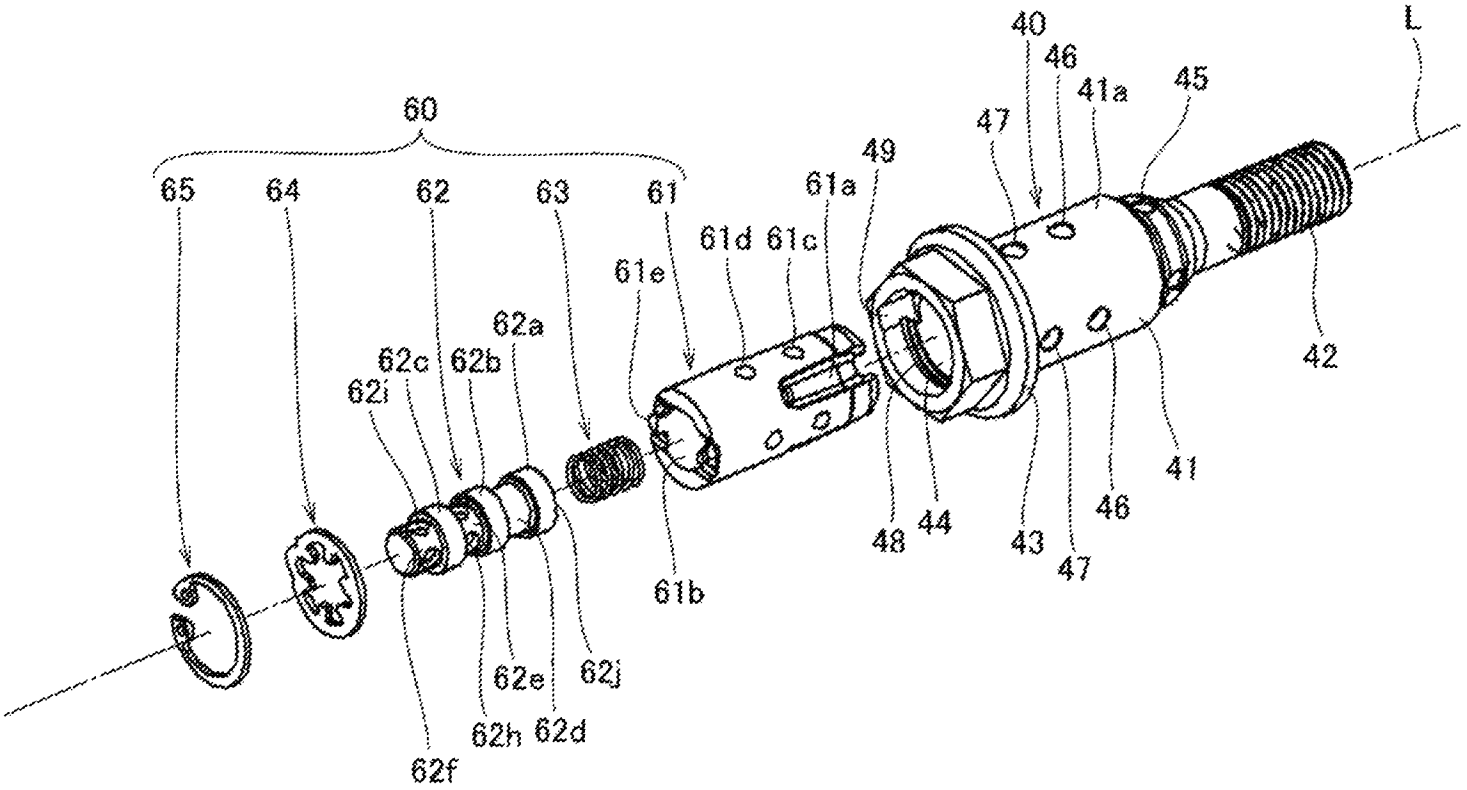
FIG. 4 is an exploded perspective view of a fastening bolt and a flow rate control valve constituting a part of the valve timing change device of the present invention.
Figure 5A:
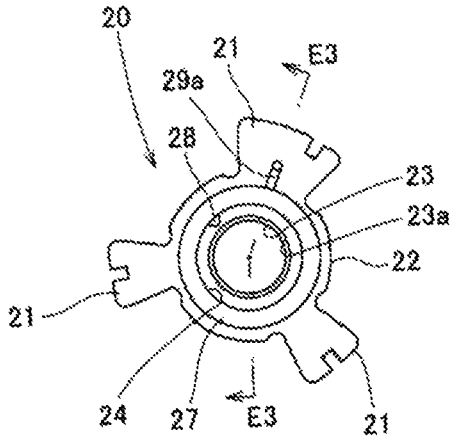
FIG. 5A is a front view illustrating a rotor body of a vane rotor constituting a part of the valve timing change device of the present invention.
Figure 5B:
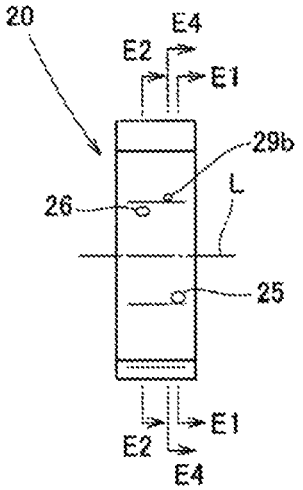
FIG. 5B is a side view illustrating the rotor body of the vane rotor constituting a part of the valve timing change device of the present invention.
Figure 5C:
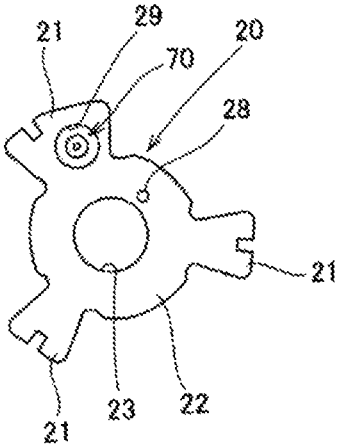
FIG. 5C is a rear view illustrating the rotor body of the vane rotor constituting a part of the valve timing change device of the present invention.
Figure 6A:
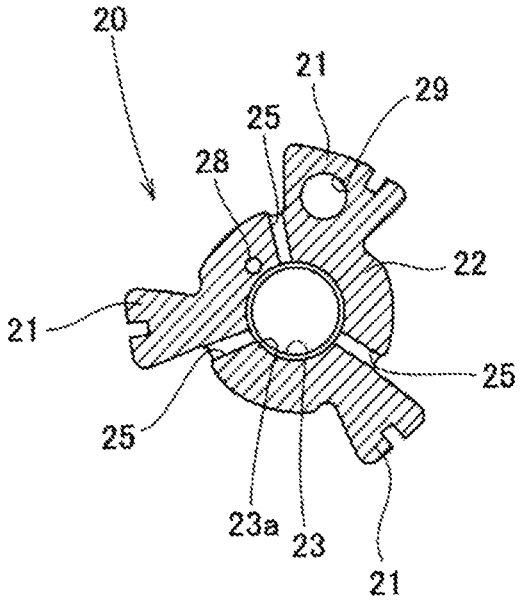
FIG. 6A is a cross-sectional view of E1-E1 in FIG. 5B, illustrating the rotor body of the vane rotor constituting a part of the valve timing change device of the present invention.
Figure 6B:
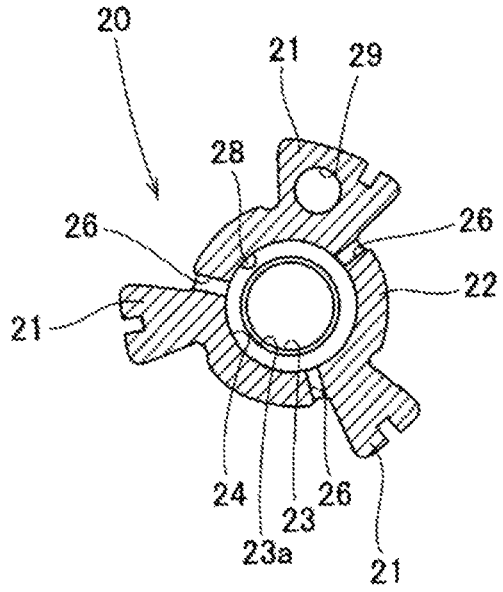
FIG. 6B is a cross-sectional view of E2-E2 in FIG. 5B, illustrating the rotor body of the vane rotor constituting a part of the valve timing change device of the present invention.
Figure 7A:
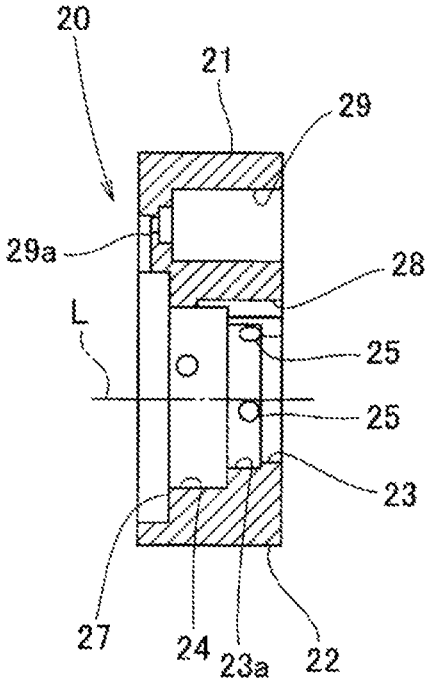
FIG. 7A is a sectional view of E3-E3 in FIG. 5A, illustrating the rotor body of the vane rotor constituting a part of the valve timing change device of the present invention.
Figure 7B:
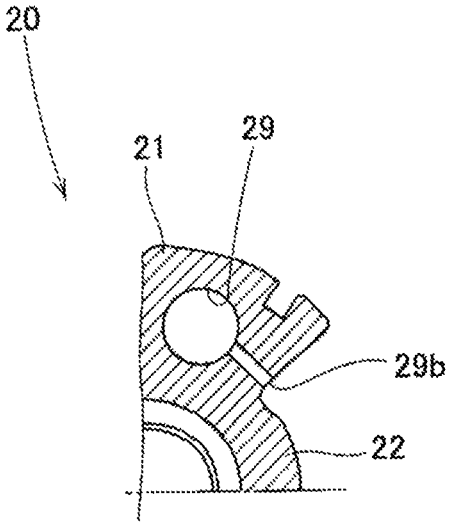
FIG. 7B is a part of a cross-sectional view of E4-E4 in FIG. 5B, illustrating the rotor body of the vane rotor constituting a part of the valve timing change device of the present invention.
Figure 8A:
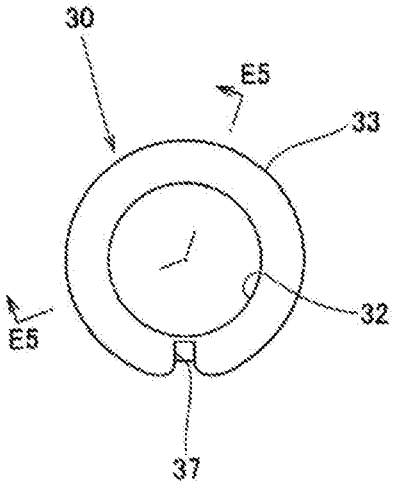
FIG. 8A is a front view illustrating a rotor sleeve which is integrally incorporated in the rotor body of the vane rotor constituting a part of the valve timing change device of the present invention.
Figure 8B:
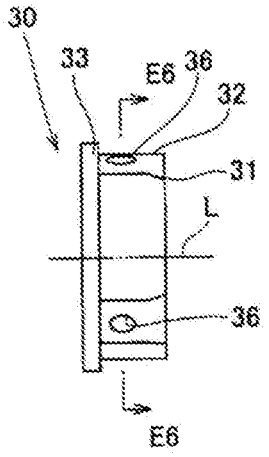
FIG. 8B is a side view illustrating the rotor sleeve which is integrally incorporated in the rotor body of the vane rotor constituting a part of the valve timing change device of the present invention.
Figure 8C:
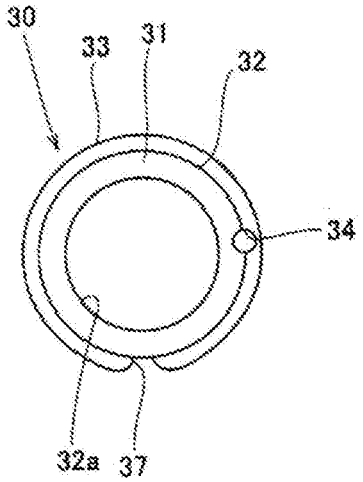
FIG. 8C is a rear view illustrating the rotor sleeve which is integrally incorporated in the rotor body of the vane rotor constituting a part of the valve timing change device of the present invention.
Figure 9A:
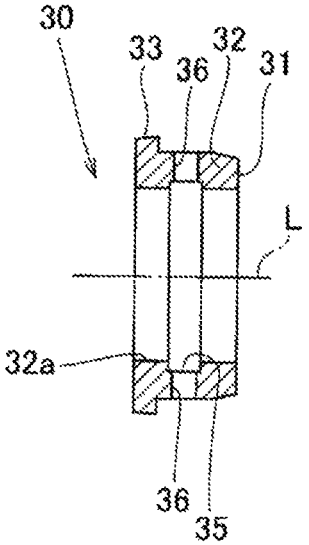
FIG. 9A is a sectional view of E5-E5 in FIG. 8A, illustrating the rotor sleeve which is integrally incorporated in the rotor body of the vane rotor constituting a part of the valve timing change device of the present invention.
Figure 9B:
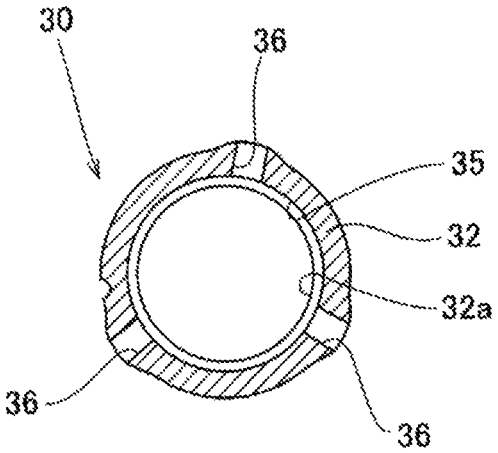
FIG. 9B is a cross-sectional view of E6-E6 in FIG. 8B, illustrating the rotor sleeve which is integrally incorporated in the rotor body of the vane rotor constituting a part of the valve timing change device of the present invention.
Figure 10:
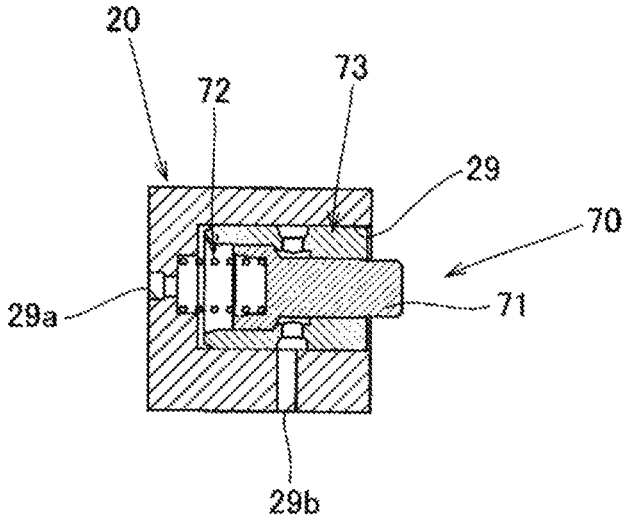
FIG. 10 is a sectional view illustrating a lock mechanism constituting a part of the valve timing change device of the present invention.

Hereinafter, embodiments of the present invention will be described with reference to the accompanying drawings FIGS. 1 to 14.

This valve timing change device includes a housing rotor 10 that rotates on an axis L of a cam shaft S, a rotor body 20 and a rotor sleeve 30 that serve as a vane rotor rotating integrally with the cam shaft S, a fastening bolt 40 that fastens the vane rotor such that the vane rotor rotates integrally with the cam shaft S, an urging spring 50, a flow rate control valve 60 that controls the flow rate of oil, a lock mechanism 70 that can lock the vane rotor into the housing rotor 10, and the like.

The flow rate control valve 60 is controlled to be driven by, for example, an electromagnetic actuator attached to a chain cover (not illustrated) or the like, independently from the device.

The cam shaft S is supported to be rotatable about the axis L by a bearing (not illustrated) formed in a cylinder head (not illustrated) of an engine, rotates in one direction CW, and drives an intake valve or an exhaust valve of the engine to be opened and closed due to a cam operation.

In its end portion region, the cam shaft S includes a cylindrical portion S1 which turnably supports the housing rotor 10, an oil passage S2 through which oil guided from an oil pan (not illustrated) is supplied to an oil passage 45 of the fastening bolt 40, a female screw portion S3 which fastens the fastening bolt 40, and a fitting hole S4 in which a positioning pin P is fitted.

The housing rotor 10 is rotatably supported on the axis L of the cam shaft S, is interlocked with rotation of a crank shaft via a chain or the like, and transmits rotary drive force of the crank shaft to the cam shaft S via a vane rotor (20 and 30).

The housing rotor 10 has a structure divided into two parts constituted of a substantially disk-shaped first housing member 11 and a bottomed cylinder-shaped second housing member 12 which is coupled to a front surface side of the first housing member 11.

The housing rotor 10 demarcates an accommodation chamber R which accommodates the vane rotor to be relatively rotatable within a predetermined angle range $\Delta\theta$ (angle range between a maximum advance angle position $\theta a$ and a maximum delay angle position $\theta r$) and accommodates the lock mechanism 70. Vane portions 21 of the accommodated vane rotor divide the accommodation chamber R into two parts, that is, an advance angle chamber 10*a* and a delay angle chamber 10*b*.

The first housing member 11 includes a sprocket 11*a* around which the chain for transmitting rotary drive force of the crank shaft is wound, an inner circumferential surface 11*b*, a wall surface 11, a fitting hole 11*d*, an oil passage lie, and screw holes 11*f*.

The inner circumferential surface 11*b* is formed to be turnably fitted in the cylindrical portion S1 of the cam shaft S.

The wall surface 11*c* is formed such that a rear surface of the rotor body 20 slidably comes into contact therewith.

The fitting hole 11*d* is formed such that a lock pin 71 included in the lock mechanism 70 is fitted therein.

The oil passage lie is formed to supply and discharge oil with respect to the fitting hole 11*d*.

The screw holes 11*f* are formed such that bolts B fastening the second housing member 12 are respectively screwed therein.

The second housing member 12 is formed to have a bottomed cylinder shape with a cylindrical wall 12*a* and a front wall 12*b*.

In addition, the second housing member 12 includes an opening portion 12*c*, three penetration holes 12*d* respectively passing the bolts B, three shoe portions 12*e*, a hook groove portion 12*f*, an accommodation recess portion 12*g*, and a ring-shaped coupling portion 12*h*, in addition to the cylindrical wall 12*a* and the front wall 12*b*.

The opening portion 12*c* is formed to have the center on the axis L such that the fastening bolt 40 passes therethrough.

The three shoe portions 12*e* protrude from the cylindrical wall 12*a* toward the center (axis L) on the rear surface side of the front wall 12*b* and are formed to be disposed at equal intervals in a circumferential direction.

The hook groove portion 12*f* is formed by cutting out a part of the opening portion 12*c* such that a first end portion 52 of the urging spring 50 is fitted and hooked therein.

The accommodation recess portion 12*g* is formed to accommodate a coil portion 51 of the urging spring 50.

The ring-shaped coupling portion 12*h* is formed to be fitted and coupled to an outer circumferential edge region on the wall surface 11*c* of the first housing member 11.

The vane rotor (the rotor body 20 and the rotor sleeve 30) is accommodated in the accommodation chamber R of the housing rotor 10 and divides the accommodation chamber R into two parts, that is, the advance angle chamber 10*a* and the delay angle chamber 10*b* such that the advance angle chamber 10*a* and the delay angle chamber 10*b* are demarcated in cooperation with the housing rotor 10. The vane rotor rotates integrally with the cam shaft S.

The rotor body 20 is formed using a material having a thermal expansion coefficient greater than that of the fastening bolt 40, for example, a light metal material such as an aluminum-based material.

In addition, the rotor body 20 includes three vane portions 21, a hub portion 22 which integrally holds the three vane portions 21 at substantially equal intervals, a small-diameter inner circumferential portion 23, a large-diameter inner circumferential portion 24 into which the rotor sleeve 30 is press-fitted, three advance angle oil passages 25, three delay angle oil passages 26, an opening end surface 27, a positioning hole 28 which serves as a positioning portion, a recess portion 29 into which the lock mechanism 70 is fitted, pressure adjustment holes 29*a* and 29*b* which communicate with the recess portion 29, and seal members which are fitted into groove portions formed at tips of the vane portions 21.

The small-diameter inner circumferential portion 23 is formed to demarcate an advance angle oil passage 23*a* constituting a ring-shaped groove in cooperation with a ring-shaped end surface 31 of the press-fitted rotor sleeve 30 and is formed to have an inner diameter dimension to be assembled to be in tight contact with an outer circumferential surface 41*a* of the fastening bolt 40.

The large-diameter inner circumferential portion 24 is formed to have a larger diameter than the small-diameter inner circumferential portion 23 and is formed to have an inner diameter dimension such that no gap is generated in the entire region of a change range of a temperature receiving when the device is used, in a state in which a tubular portion 32 of the rotor sleeve 30 formed of an iron-based material is press-fitted.

The advance angle oil passages 25 are formed to radially extend in the hub portion 22 and to communicate with the advance angle oil passage 23*a*.

The delay angle oil passages 26 are formed to radially extend in the hub portion 22 and to communicate with the large-diameter inner circumferential portion 24.

The opening end surface 27 is formed to have a counterbored shape in an end portion of the large-diameter inner circumferential portion 24.

The positioning hole 28 is formed such that the positioning pin P attached to the cam shaft S is fitted therein.

The rotor sleeve 30 is formed of an iron-based material having a thermal expansion coefficient equal to that of the fastening bolt 40 and is press-fitted into the rotor body 20.

In addition, the rotor sleeve 30 includes the ring-shaped end surface 31, the tubular portion 32, a flange portion 33, a positioning hole 34 serving as a positioning portion, a delay angle oil passage 35 having a ring shape, three delay angle oil passages 36, and a hooking portion 37.

The ring-shaped end surface 31 is formed to demarcate the advance angle oil passage 23*a* in cooperation with the small-diameter inner circumferential portion 23 of the rotor body 20.

The tubular portion 32 is formed to be press-fitted into the large-diameter inner circumferential portion 24 of the rotor body 20.

The flange portion 33 is formed to be pressed in an axis L direction such that its inner surface abuts on the opening end surface 27 of the large-diameter inner circumferential portion 24 and the fastening bolt 40 directly abuts on its outer surface.

The positioning hole 34 is formed such that the positioning pin P for positioning an angular position about the axis L with respect to the rotor body 20 and the cam shaft S is fitted therein.

The delay angle oil passage 35 is formed on an inner circumferential surface 32*a* of the tubular portion 32.

The delay angle oil passages 36 are formed to radially extend in the tubular portion 32, to penetrate the tubular portion 32, and to communicate with the delay angle oil passage 35.

The hooking portion 37 is formed by cutting out a part of the flange portion 33 such that a second end portion 53 of the urging spring 50 is hooked therein.

Here, the linear dimension of the tubular portion 32 in the axis L direction is formed to be slightly shorter than the linear dimension of the large-diameter inner circumferential portion 24 of the rotor body 20 in the axis L direction.

In addition, in regard to the outer diameter dimension of the tubular portion 32, three regions including the areas in the vicinity of places having the delay angle oil passages 36 open are formed to have greater outer diameter dimensions than other regions.

The tubular portion 32 is formed such that no gap is generated in the entire region of a change range of a temperature receiving when the device is used, in a state in which the tubular portion 32 is press-fitted into the large-diameter inner circumferential portion 24 of the rotor body 20 formed of an aluminum-based material.

That is, the rotor sleeve 30 is partially press-fitted into the large-diameter inner circumferential portion 24 of the rotor body 20.

In addition, the inner circumferential surface 32*a* of the tubular portion 32 is formed to have an inner diameter dimension such that the inner circumferential surface 32*a* is assembled in a state of being in tight contact with the outer circumferential surface 41*a* of the fastening bolt 40.

The fastening bolt 40 directly abuts on the rotor sleeve 30 of the vane rotor and fastens the vane rotor (20 and 30) such that the vane rotor (20 and 30) rotates integrally with the cam shaft S while a pressing force is applied in the axis L direction. The fastening bolt 40 is formed of an iron-based material having high mechanical strength.

The fastening bolt 40 includes a cylindrical portion 41 which has the outer circumferential surface 41*a*, a male screw portion 42 which is positioned on the tip side of the cylindrical portion 41, a flanged head portion 43, an insertion portion 44, the oil passage 45, oil passages 46, oil passages 47, a ring-shaped groove 48, and a positioning portion 49.

The outer circumferential surface 41*a* of the cylindrical portion 41 is formed to have an outer diameter dimension such that the outer circumferential surface 41*a* can be fitted in the axis L direction and come into tight contact with no gap with respect to the inner circumferential surface 32*a* of the tubular portion 32 of the rotor sleeve 30 and an inner circumferential surface of the small-diameter inner circumferential portion 23 of the rotor body 20.

The flanged head portion 43 is formed to directly abut on the flange portion 33 of the rotor sleeve 30 and to press the flange portion 33 in the axis L direction, on a side opposite to the male screw portion 42.

The insertion portion 44 is formed to have a bottomed shape such that the flow rate control valve 60 is fitted therein, by thinning the inside of the cylindrical portion 41. The oil passage 45 is formed in a connection region of the cylindrical portion 41 and the male screw portion 42.

The oil passages 46 are formed to be open on the outer circumferential surface 41*a* of the cylindrical portion 41 and to communicate with the advance angle oil passage 23*a*.

The oil passages 47 are formed to be open on the outer circumferential surface 41*a* of the cylindrical portion 41 and to communicate with the delay angle oil passage 35.

The ring-shaped groove 48 is formed such that a washer 64 and a snap ring 65 are fitted therein on an opening end side of the insertion portion 44.

The positioning portion 49 is formed to have a recessed shape receiving a positioning portion 61*e* such that positioning of a sleeve 61 of the flow rate control valve 60 about the axis L is performed.

The fastening bolt 40 passes the opening portion 12*c* of the second housing member 12 and is inserted into the tubular portion 32 of the rotor sleeve 30 press-fitted into the rotor body 20, and the small-diameter inner circumferential portion 23 of the rotor body 20. The male screw portion 42 is screwed into the female screw portion S3 of the cam shaft S.

Accordingly, the fastening bolt 40 directly abuts on the rotor sleeve 30, applies a pressing force (fastening force) in the axis L direction, and fastens the vane rotor (20 and 30) such that the vane rotor (20 and 30) rotates integrally with the cam shaft S.

In addition, in this fastened state, the outer circumferential surface 41*a* of the fastening bolt 40 blocks communication between the advance angle oil passage 23*a* and the delay angle oil passage 35 constituting the ring-shaped grooves of the rotor body 20.

That is, the rotor sleeve 30 is press-fitted into the rotor body 20, and the fastening bolt 40 fastens the vane rotor (20 and 30) such that the vane rotor (20 and 30) rotates integrally with the cam shaft S via the rotor sleeve 30.

According to this configuration, as the vane rotor, it is possible to obtain a configuration including the rotor body 20 which is formed of a material having a thermal expansion coefficient greater than that of the fastening bolt 40, and the rotor sleeve 30 which is integrally incorporated while being not in contact with the cam shaft S formed of a material having a thermal expansion coefficient equal to that of the fastening bolt 40 and being in tight contact with the outer circumferential surface 41*a* of the fastening bolt 40, in a region in which at least the advance angle oil passage 23*a* and the delay angle oil passage 35 are blocked from each other.

In addition, since the rotor sleeve 30 is press-fitted into the rotor body 20 and is integrally incorporated therein, it is possible to obtain the vane rotor including the advance angle oil passages 23*a* and 25 communicating with the advance angle chamber 10*a*, and the delay angle oil passages 35, 36, and 26 communicating with the delay angle chamber 10*b*, where the advance angle oil passages 23*a* and 25, and the delay angle oil passages 35, 36, and 26 are blocked from each other by the outer circumferential surface 41*a* of the fastening bolt 40.

According to the relationship between the vane rotor including the rotor body 20 and the rotor sleeve 30, and the fastening bolt 40 constituting the configuration described above, even if thermal expansion occurs in the fastening bolt 40 and the vane rotor, the rotor sleeve 30 formed of a material having a thermal expansion coefficient equal to that of the fastening bolt 40 is integrally incorporated in a region in which the rotor sleeve 30 comes into tight contact with the outer circumferential surface 41*a* of the fastening bolt 40 and at least the advance angle oil passage 23*a* and the delay angle oil passage 45 are blocked from each other. Therefore, no gap is generated between the outer circumferential surface 41*a* of the fastening bolt 40 and the inner circumferential surface 32*a* of the rotor sleeve 30.

Particularly, the rotor sleeve 30 is not in contact with the cam shaft S and comes into contact with only the outer circumferential surface 41*a* of the fastening bolt 40. Therefore, for example, the rotor sleeve 30 is not affected by a fitting relationship, unevenness in assembly, and the like concerned when a rotor sleeve is fitted in a cam shaft and is in a contact state.

Therefore, it is possible to achieve a reliable contact state between the inner circumferential surface 32*a* of the rotor sleeve 30 and the outer circumferential surface 41*a* of the fastening bolt 40.

That is, the advance angle oil passage 23*a* and the delay angle oil passage 45 do not communicate with each other due to a gap on the outer circumferential surface 41*a* of the fastening bolt 40, so that oil leakage is prevented and oil can be guided to a desired oil passage. Therefore, opening/closing timing can be changed with high accuracy.

In addition, since the rotor sleeve 30 is integrally incorporated in the rotor body 20 by being press-fitted therein, when a press-fit yield is maintained in a fitting state in which no gap is generated at all times within a range of thermal deformation, no gap is generated even if both thereof thermally expand, and press-fitting work can also be easily performed.

Moreover, since the fastening bolt 40 directly abuts on the rotor sleeve 30 having an equal thermal expansion coefficient and is fastened thereto, even in an environment causing thermal deformation, relative deviation due to thermal deformation does not occur between the fastening bolt 40 and the rotor sleeve 30.

Therefore, compared to when the fastening bolt 40 directly abuts on a rotor body 20 having a different thermal expansion coefficient, the fastening bolt 40 can be prevented from becoming loosened or the like. Therefore, oil leakage or the like between the advance angle oil passage 23*a* and the delay angle oil passage 45 can be prevented.

Particularly, when the fastening bolt 40 and the rotor sleeve 30 are formed of an iron-based material, since the strength of the fastening bolt 40 is ensured and no thermal expansion difference occurs between the fastening bolt 40 and the rotor sleeve 30, generation of a gap can be prevented.

In addition, when the rotor body 20 is formed of an aluminum-based material, weight reduction can be achieved and responsiveness can be enhanced.

Moreover, in the rotor sleeve 30 and the rotor body 20, the positioning hole 34 of the rotor sleeve 30 and the positioning hole 28 of the rotor body 20 are fitted to the common positioning pin P for positioning the angular position about the axis L with respect to the cam shaft S. Thus, positioning of three components can be realized all at once.

Therefore, it is possible to reliably prevent mutual positional deviation between the delay angle oil passages 36 provided in the rotor sleeve 30 and the delay angle oil passages 26 provided in the rotor body 20.

In addition, according to the vane rotor in which the rotor sleeve 30 is press-fitted into the rotor body 20 and is incorporated therein, since the rotor sleeve 30 includes the ring-shaped end surface 31 and the tubular portion 32, when the tubular portion 32 of the rotor sleeve 30 is press-fitted into the large-diameter inner circumferential portion 24 of the rotor body 20, the ring-shaped end surface 31 demarcates the advance angle oil passage 23*a* constituting the ring-shaped groove, in cooperation with the small-diameter inner circumferential portion 23, and the tubular portion 32 of the press-fitted rotor sleeve 30 demarcates the delay angle oil passage 35 constituting the ring-shaped groove.

Accordingly, since there is no need to perform boring for constituting a ring-shaped groove with respect to the rotor body 20, labor for processing can be reduced in its entirety and productivity of vane rotors can be enhanced.

Moreover, since the rotor sleeve 30 is configured to include the flange portion 33, when the fastening bolt 40 is screwed in and the flange portion 33 is pressed in the axis L direction toward the opening end surface 27 of the rotor body 20, press-fitting of the rotor sleeve 30 can be light press-fitting, and the vane rotor (20 and 30) can be reliably fastened such that the vane rotor (20 and 30) rotates integrally with the cam shaft S, due to the pressing force in the axis L direction.

The urging spring 50 rotatively urges the vane rotor (20 and 30) in one direction with respect to the housing rotor 10.

The urging spring 50 is a torsion coil-shaped spring having the coil portion 51, the first end portion 52, and the second end portion 53. The urging spring 50 is disposed between the opening end surface 27 of the rotor body 20 and the accommodation recess portion 12*g* of the second housing member 12 inside the housing rotor 10.

The first end portion 52 is formed to extend in a direction perpendicular to the axis L and to extend outward in the radial direction of the coil portion 51 from the coil portion 51.

The second end portion 53 is formed to extend in a direction perpendicular to the axis L and to extend toward the center of the coil portion 51 from the coil portion 51.

The coil portion 51 is accommodated by being fitted to abut on the opening end surface 27 of the rotor body 20. The second end portion 53 is fitted and hooked in the hooking portion 37 of the rotor base 30. The first end portion 52 is fitted and hooked in the hook groove portion 12*f* of the second housing member 12. Accordingly, the urging spring 50 rotatively urges the vane rotor (20 and 30) in an advance angle direction with respect to the housing rotor 10.

In this manner, when the urging spring 50 urging the vane rotor (20 and 30) in the advance angle direction is employed, rattling of the vane rotor (20 and 30) can be prevented, hydraulic pressure required for an advance angle can be reduced, and responsiveness can be improved.

Moreover, controllability can be improved by setting a load of the urging spring 50 such that a difference between operation torque and load torque becomes substantially equal at the time of an advance angle and at the time of a delay angle.

In addition, since the second end portion 53 of the urging spring 50 is hooked in the hooking portion 37 provided in the flange portion 33 of the rotor sleeve 30, instead of the rotor body 20, collapse of the urging spring 50, abrasion of the rotor body 20, and the like can be prevented by receiving an end surface of the coil portion 51 with the opening end surface 27 around the flange portion 33.

The flow rate control valve 60 is incorporated inside the fastening bolt 40 and controls the flow rate of oil (operation oil).

Here, the flow rate control valve 60 includes the sleeve 61 which is fitted into the insertion portion 44 of the fastening bolt 40, a spool 62 which is fitted inside the sleeve 61 to freely reciprocate in the axis L direction, an urging spring 63 which urges the spool 62 in a direction protruding from the sleeve 61, the washer 64 which stops the sleeve 61 from coming off and prevents the spool 62 from falling off, and a C-type snap ring 65 which fixes the washer 64.

The sleeve 61 is formed to come into tight contact with the insertion portion 44 of the fastening bolt 40 and to be fitted therein, using a material having a thermal expansion coefficient greater than that of the fastening bolt 40, for example, an aluminum-based material.

Here, the sleeve 61 includes an oil passage 61*a*, an inner circumferential surface 61*b*, oil passages 61*c* and 61*d*, the positioning portion 61*e*, and a receiving portion 61*f*.

The oil passage 61*a* is formed from a recessed groove to the penetration hole communicating with the inside such that oil to be supplied via the oil passage 45 of the fastening bolt 40 is guided to the inside.

The inner circumferential surface 61*b* is formed such that the spool 62 is slidably fitted therein.

The oil passages 61*c* and 61*d* are formed to penetrate the sleeve 61 from the inner circumferential surface 61*b* radially outward.

The positioning portion 61*e* is formed to have a protrusion shape such that the sleeve 61 is fitted into the positioning portion 49 of the fastening bolt 40 and is subjected to positioning.

The receiving portion 61*f* is formed to receive one end portion of the urging spring 63.

For example, the spool 62 is formed of an aluminum-based material into a substantially cylindrical bottomed shape.

Here, the spool 62 includes a first valve portion 62*a*, a second valve portion 62*b*, and a sliding portion 62*c* which individually come into tight contact with the inner circumferential surface 61*b* of the sleeve 61 and slide. The spool 62 also includes an oil passage 62*d*, an oil passage 62*e*, a diameter-reduced portion 62*f*, an oil passage 62*g*, an oil passage 62*h*, an oil passage 62*i*, and a receiving portion 62*j*.

The oil passage 62*d* is formed to constitute a ring-shaped groove between the first valve portion 62*a* and the second valve portion 62*b*.

The oil passage 62*e* is formed to constitute a ring-shaped groove between the second valve portion 62*b* and the sliding portion 62*c*.

The diameter-reduced portion 62*f* is reduced in diameter from the sliding portion 62*c* toward the end portion.

The oil passage 62*g* is formed to internally extend in the axis direction.

The oil passage 62*h* is formed to constitute a penetration hole in the oil passage 62*e* communicating with the oil passage 62*g*.

The oil passage 62*i* is formed to constitute a penetration hole in the diameter-reduced portion 62*f* communicating with the oil passage 62*g*.

The receiving portion 62*j* is formed to receive the other end portion of the urging spring 63.

The urging spring 63 is a compression coil spring, which is formed to be disposed between the receiving portion 61*f* of the sleeve 61 and the receiving portion 62*j* of the spool 62 and to apply urging force in a direction in which the spool 62 is pushed out from the sleeve 61.

When the flow rate control valve 60 is assembled in the fastening bolt 40, first, the sleeve 61 is subjected to positioning in the insertion portion 44 of the fastening bolt 40, thereby being fitted and fixed thereto. Here, a part of the sleeve 61 on the tip side is lightly press-fitted and fixed to the insertion portion 44.

Figure 11A:
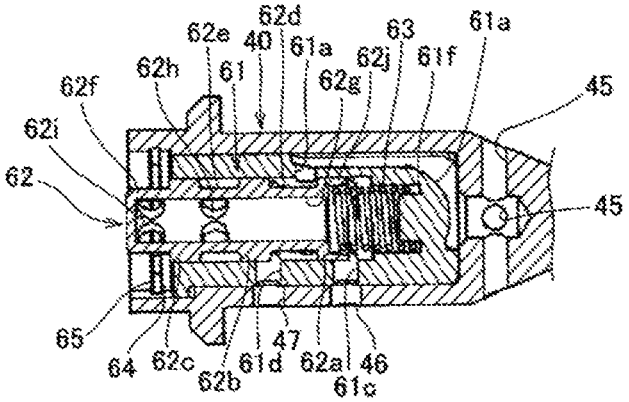
FIG. 11A is a sectional view illustrating a positional relationship between the flow rate control valve and an oil passage of the fastening bolt constituting a part of the valve timing change device of the present invention in a state of a delay angle mode.
Figure 11B:
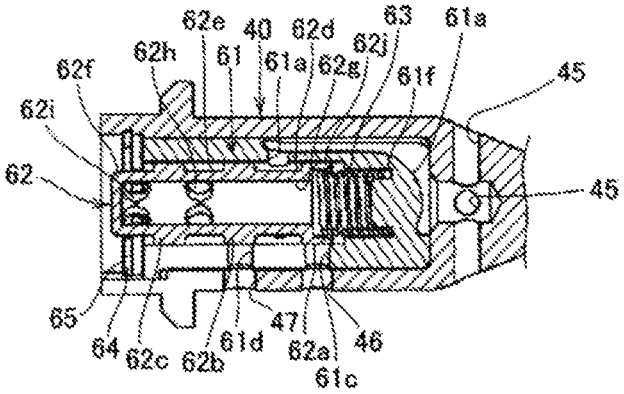
FIG. 11B is a sectional view illustrating a positional relationship between the flow rate control valve and the oil passage of the fastening bolt constituting a part of the valve timing change device of the present invention in a state of a holding mode.
Figure 11C:
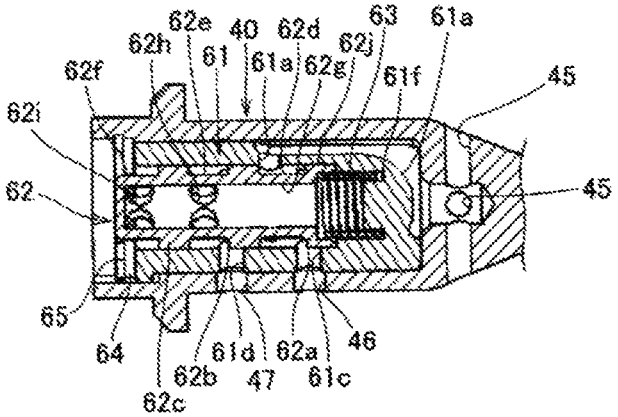
FIG. 11C is a sectional view illustrating a positional relationship between the flow rate control valve and the oil passage of the fastening bolt constituting a part of the valve timing change device of the present invention in a state of an advance angle mode.

In addition, in this state, as illustrated in FIGS. 11A to 11C, the oil passage 45 and the oil passage 61*a* communicate with each other, the oil passages 46 and the oil passage 61*c* communicate with each other, and the oil passages 47 and the oil passage 61*d* communicate with each other.

Subsequently, the urging spring 63 is inserted into the sleeve 61, and the spool 62 is inserted from the outside thereof. The spool 62 is pushed against the urging force of the urging spring 63, and the washer 64 and the snap ring 65 are fitted into the ring-shaped groove 48 of the fastening bolt 40.

In this state, as in a delay angle mode illustrated in FIG. 11A, while the spool 62 is pushed outside due to urging force of the urging spring 63, the outer end surface of the sliding portion 62*c* is in a state of abutting on the washer 64 and having stopped. The first valve portion 62*a* blocks communication between the oil passage 61*a* and the oil passages 61*c* and 46, and oil inside the advance angle chamber 10*a* is in a state of being discharged to the outside via the advance angle oil passages 25 and 23*a*→the oil passages 46→the oil passage 61*c*→the oil passage 62*g*→the oil passage 62*i*.

In addition, the second valve portion 62*b* allows communication between the oil passage 61*a* and the oil passages 61*d* and 47, and oil is in a state of being guided into the delay angle chamber 10*b* via the oil passage 45→the oil passage 61*a*→the oil passage 62*d*→the oil passage 61*d*→the oil passages 47→the delay angle oil passages 35, 36, and 26.

As in a holding mode illustrated in FIG. 11B, when the spool 62 is pushed by the electromagnetic actuator A as much as a predetermined amount, the first valve portion 62*a* blocks communication between the oil passage 61*a* and the oil passages 61*c* and 46 and blocks communication between the oil passages 46 and 61*c* and the oil passage 62*g*.

In addition, the second valve portion 62*b* blocks communication between the oil passage 61*a* and the oil passages 61*d* and 47 and blocks communication between the oil passages 47 and 61*d* and the oil passages 62*h* and 62*g*. Oil is in a state of being inhibited from flowing in and flowing out with respect to the advance angle chamber 10*a* and the delay angle chamber 10*b*.

Moreover, as in an advance angle mode illustrated in FIG. 11C, when the spool 62 is further pushed by the electromagnetic actuator A as much as a predetermined amount, the first valve portion 62*a* allows communication between the oil passage 61*a* and the oil passages 61*c* and 46, and oil is in a state of being guided into the advance angle chamber 10*a* via the oil passage 45→the oil passage 61*a*→the oil passage 62*d*→the oil passage 61*c*→the oil passages 46→the advance angle oil passages 23*a* and 25.

In addition, the second valve portion 62*b* blocks communication between the oil passage 61*a* and the oil passages 61*d* and 47, and oil inside the delay angle chamber 10*b* is in a state of being discharged to the outside via the delay angle oil passages 26, 36, and 35→the oil passages 47→the oil passage 61*d*→the oil passage 62*e*→the oil passage 62*g*→the oil passage 62*i*.

In this manner, since the flow rate control valve 60 is configured to be incorporated in the fastening bolt 40, integration as a hydraulic pressure system and a pressure loss of oil as a fluid medium can be reduced, and responsiveness when changing valve timing can be enhanced.

Moreover, when the flow rate control valve 60 is incorporated in the fastening bolt 40 in advance and is handled as a module component, management workloads and the like of components can be reduced.

The lock mechanism 70 locks the vane rotor (20 and 30) at a predetermined position (here, the maximum delay angle position θr) of the predetermined angle range Δθ with respect to the housing rotor 10, and the lock state is canceled due to the hydraulic pressure.

Here, the lock mechanism 70 is constituted of the lock pin 71, an urging spring 72, and a cylindrical holder 73.

The lock pin 71 is formed to freely reciprocate in a direction of the axis L and to be able to protrude from a rear end surface of the rotor body 20.

The urging spring 72 is formed to apply urging force in a direction in which the lock pin 71 protrudes.

The cylindrical holder 73 is formed to be fitted into the recess portion 29 of the rotor body 20 such that the lock pin 71 urged by the urging spring 72 is held to freely reciprocating manner.

In a state in which the hydraulic pressure of oil which is supplied via the advance angle oil passages 25 and the oil passage lie and presses the lock pin 71 has dropped, when the lock pin 71 is urged by the urging spring 72 and is fitted in the fitting hole 11*d* of the housing rotor 10 (first housing member 11), the vane rotor (20 and 30) is locked at a predetermined position (here, the maximum delay angle position θr) within the predetermined angle range Δθ with respect to the housing rotor 10.

Meanwhile, when the hydraulic pressure applied to the lock pin 71 rises due to oil guided via the advance angle oil passages 25→the oil passage lie, the lock pin 71 is depressed from the rear end surface of the rotor body 20 and the lock state is canceled.

The electromagnetic actuator A is fixed to the chain cover (not illustrated) or the like of the engine and includes a plunger A1 which reciprocates in the axis L direction, abuts on the end portion of the spool 62, and applies pushing force, and an excitation coil A2 which is disposed around the plunger A1.

When the electromagnetic actuator A is suitably energized and controlled, and when the protrusion amount of the plunger A1 is adjusted, the amount of pushing the spool 62 against the urging force of the urging spring 63 is suitably adjusted, and the delay angle mode illustrated in FIG. 11A, the holding mode illustrated in FIG. 11B, or the advance angle mode illustrated in FIG. 11C is selected.

Next, an operation of the valve timing change device will be described with reference to FIGS. 11A to 14.

Figure 12:
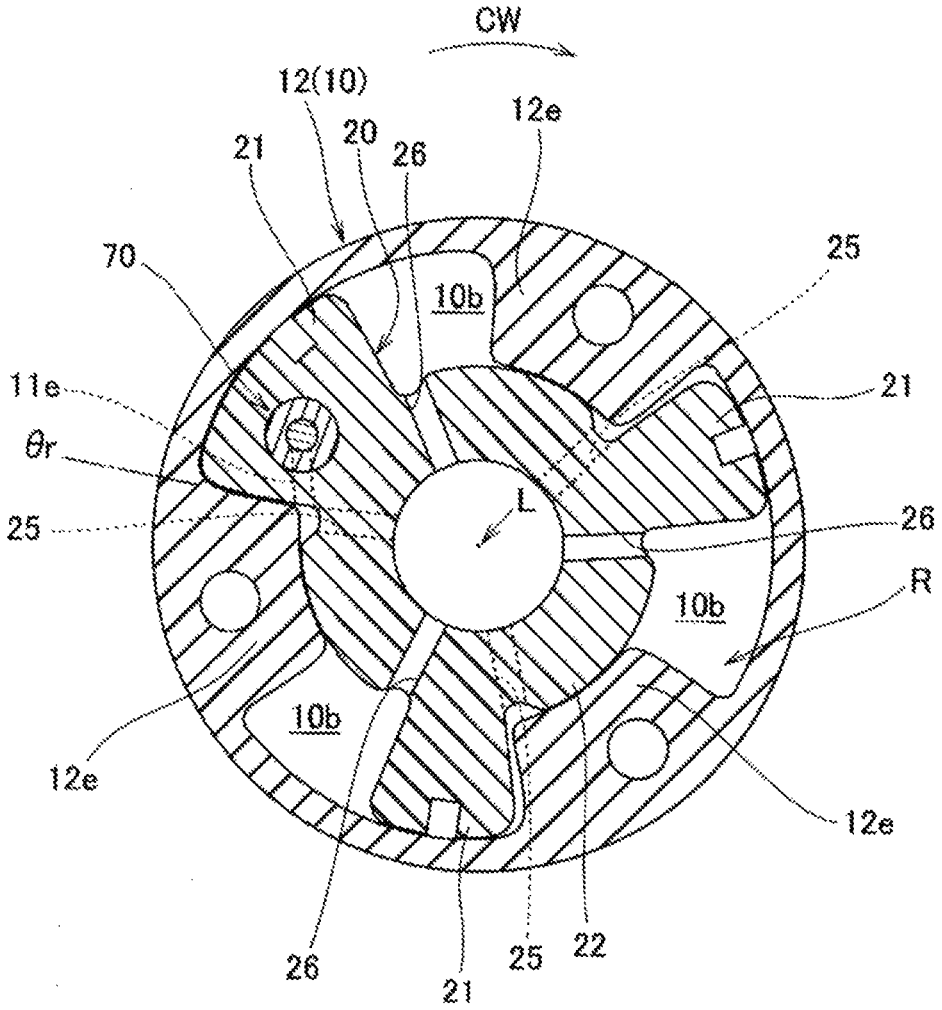
FIG. 12 is a cross-sectional view illustrating a state in which the vane rotor constituting a part of the valve timing change device of the present invention is at a maximum delay angle position.

In a state in which the engine stops, as illustrated in FIG. 12, oil inside the advance angle chamber 10*a* is discharged, and the vane rotor (20 and 30) is positioned at the maximum delay angle position θr against the urging force of the urging spring 50.

In addition, the lock pin 71 of the lock mechanism 70 is fitted in the fitting hole 11*d*, and the vane rotor (20 and 30) is in a state of being locked with respect to the housing rotor 10.

Accordingly, when the engine starts, the engine can start while preventing fluttering or the like of the vane rotor (20 and 30).

Subsequently, when the engine starts, and for example, when the advance angle mode as illustrated in FIG. 11C is selected, oil is supplied to a pressure receiving portion of the lock pin 71 via the oil passage 45→the oil passage 61*a*→the oil passage 62*d*→the oil passage 61*c*→the oil passages 46→the advance angle oil passage 23*a*→the advance angle oil passages 25→the oil passage 11*e*.

The lock pin 71 is pressed by the hydraulic pressure and deviates from the fitting hole 11*d*, so that the lock state is canceled. In addition, the hydraulic pressure of oil inside the advance angle chamber 10*a* rises, and the vane rotor (20 and 30) rotates to the advance angle side with respect to the housing rotor 10.

After the engine has started, the flow rate control valve 60 is suitably switched and the vane rotor (20 and 30), and the cam shaft S are subjected to phase control to the delay angle side (delay angle mode) or the advance angle side (advance angle mode) or are held at a predetermined intermediate angular position (holding mode).

For example, in a case of the delay angle mode, as illustrated in FIG. 11A, the spool 62 is in a state of protruding due to the urging force of the urging spring 63.

Oil inside the advance angle chamber 10*a* is discharged to the outside, for example, into the oil pan through the inside of the chain cover via the advance angle chamber 10*a*→the advance angle oil passages 25→the advance angle oil passage 23*a*→the oil passages 46→the oil passage 61*c*→the oil passage 62*g*→the oil passage 62*i*.

Meanwhile, oil is supplied to the inside of the delay angle chamber 10*b* via the oil passage 45→the oil passage 62*d*→the oil passage 61*d*→the oil passages 47→the delay angle oil passage 35→the delay angle oil passages 36→the delay angle oil passages 26.

Figure 13:
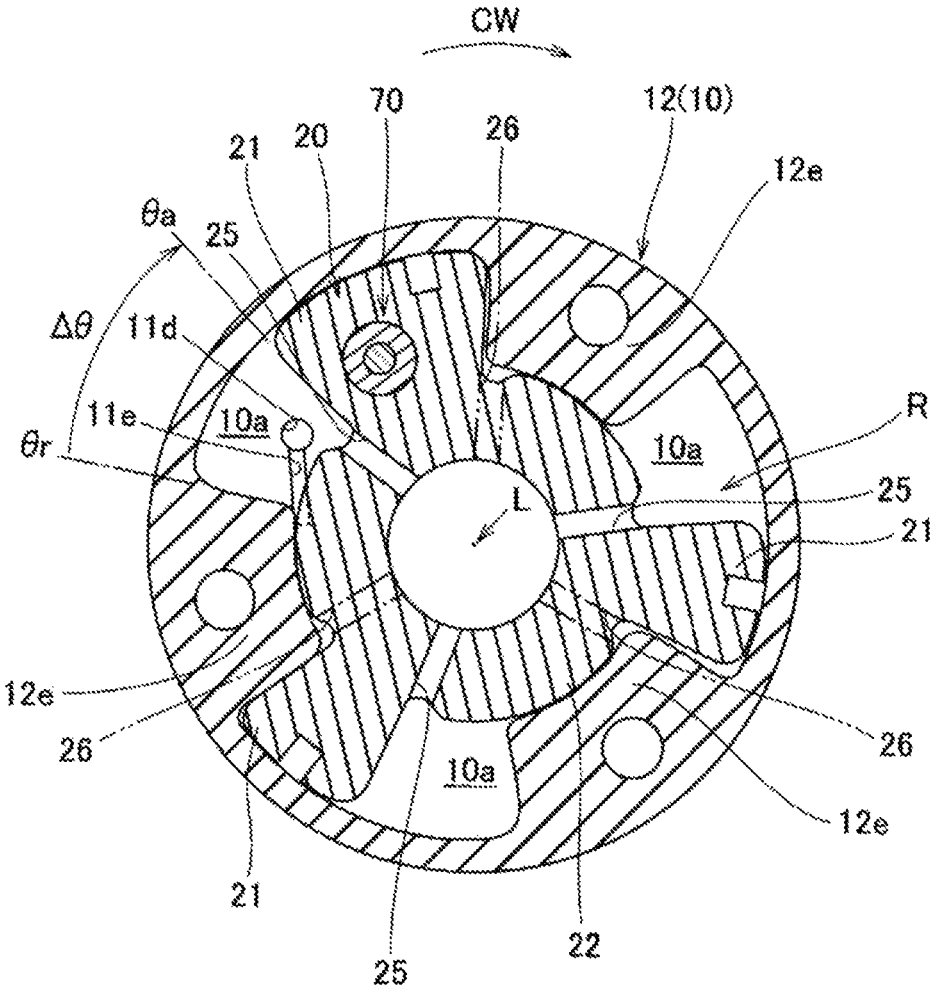
FIG. 13 is a cross-sectional view illustrating a state in which the vane rotor constituting a part of the valve timing change device of the present invention is at a maximum advance angle position.
Figure 14:
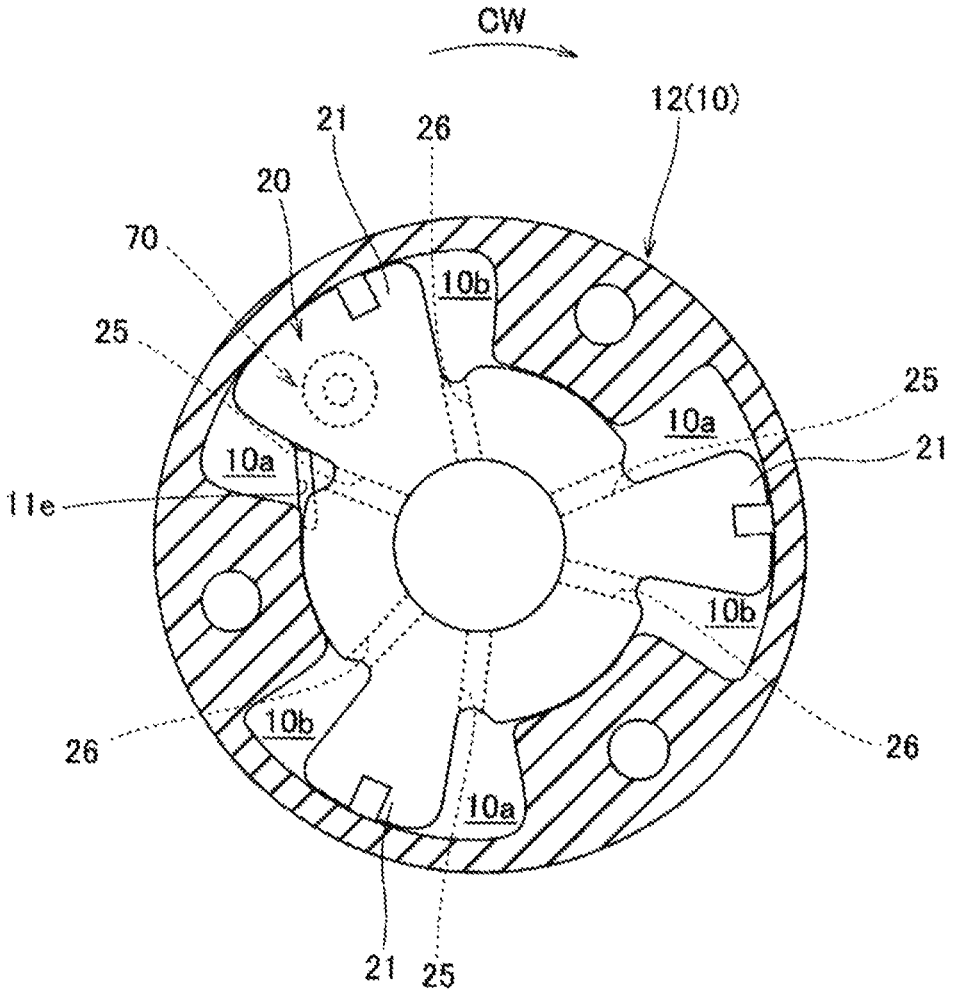
FIG. 14 is a cross-sectional view illustrating a state in which the vane rotor constituting a part of the valve timing change device of the present invention is at an intermediate position between the maximum delay angle position and the maximum advance angle position.

Accordingly, the vane rotor (20 and 30) rotates counterclockwise (to the delay angle side) with respect to the housing rotor 10 from the state as illustrated in FIG. 13 or 14 to the maximum delay angle position illustrated in FIG. 12 against the urging force of the urging spring 50 and due to the hydraulic pressure.

Meanwhile, in a case of the advance angle mode, as illustrated in FIG. 11C, the spool 62 is in a state of being pushed by the electromagnetic actuator A against the urging force of the urging spring 63 as much as a predetermined amount.

Oil inside the delay angle chamber 10*b* is discharged to the outside, for example, into the oil pan through the inside of the chain cover via the delay angle chamber 10*b*→the delay angle oil passages 26→the delay angle oil passages 36→the delay angle oil passage 35→the oil passages 47→the oil passage 61*d*→the oil passage 62*e*→the oil passage 62*g*→the oil passage 62*i*.

Meanwhile, oil is supplied to the inside of the advance angle chamber 10*a* via the oil passage 45→the oil passage 62*d*→the oil passage 61*c*→the oil passages 46→the advance angle oil passage 23*a*→the advance angle oil passages 25.

Accordingly, the vane rotor (20 and 30) rotates clockwise (to the advance angle side) with respect to the housing rotor 10 from the state as illustrated in FIG. 12 or 13 to the maximum advance angle position illustrated in FIG. 14 due to the hydraulic pressure in addition to the urging force of the urging spring 50.

Meanwhile, in a case of the holding mode, as illustrated in FIG. 11B, the electromagnetic actuator A is suitably controlled and the spool 62 is in a state of being pushed as much as a predetermined amount.

The first valve portion 62*a* blocks communication between the oil passages 61*a* and 62*d* and the oil passages 61*c* and 46 and blocks communication between the oil passages 46 and 61*c* and the oil passage 62*g*. In addition, the second valve portion 62*b* blocks communication between the oil passages 61*a* and 62*d* and the oil passages 61*d* and 47 and blocks communication between the oil passages 47 and 61*d* and the oil passages 62*e* and 62*g*, so that oil is in a state of being inhibited from flowing in and flowing out with respect to the advance angle chamber 10*a* and the delay angle chamber 10*b*.

Accordingly, as illustrated in FIG. 13, the vane rotor (20 and 30) is held at a desired intermediate position between the maximum delay angle position θr and the maximum advance angle position θa.

As described above, according to the valve timing change device constituting the configuration described above, simplification of the structure, and size reduction, weight reduction, cost reduction, facilitation of assembling work, and the like of the device are achieved. Particularly, oil leakage or the like from a gap between assembled components generated due to thermal deformation or the like is prevented, so that an expected function can be guaranteed.

Particularly, even if thermal expansion occurs in the fastening bolt 40 and the vane rotor, the rotor sleeve 30 formed of a material having a thermal expansion coefficient equal to that of the fastening bolt 40 is integrally incorporated in a region in which the rotor sleeve 30 comes into tight contact with the outer circumferential surface 41*a* of the fastening bolt 40 and at least the advance angle oil passage 23*a* and the delay angle oil passage 35 are blocked from each other. Therefore, no gap is generated between the outer circumferential surface 41*a* of the fastening bolt 40 and the inner circumferential surface 32*a* of the rotor sleeve 30.

In addition, the rotor sleeve 30 is not in contact with the cam shaft S and comes into contact with only the outer circumferential surface 41*a* of the fastening bolt 40. Therefore, for example, the rotor sleeve 30 is not affected by a fitting relationship, unevenness in assembly, and the like concerned when a rotor sleeve is fitted in a cam shaft and is in a contact state.

Therefore, it is possible to achieve a reliable contact state between the inner circumferential surface 32*a* of the rotor sleeve 30 and the outer circumferential surface 41*a* of the fastening bolt 40.

That is, the advance angle oil passage 23*a* and the delay angle oil passage 35 do not communicate with each other due to a gap on the outer circumferential surface 41*a* of the fastening bolt 40, so that oil leakage is prevented and oil can be guided to a desired oil passage. Therefore, opening/closing timing can be changed with high accuracy.

Figure 15:
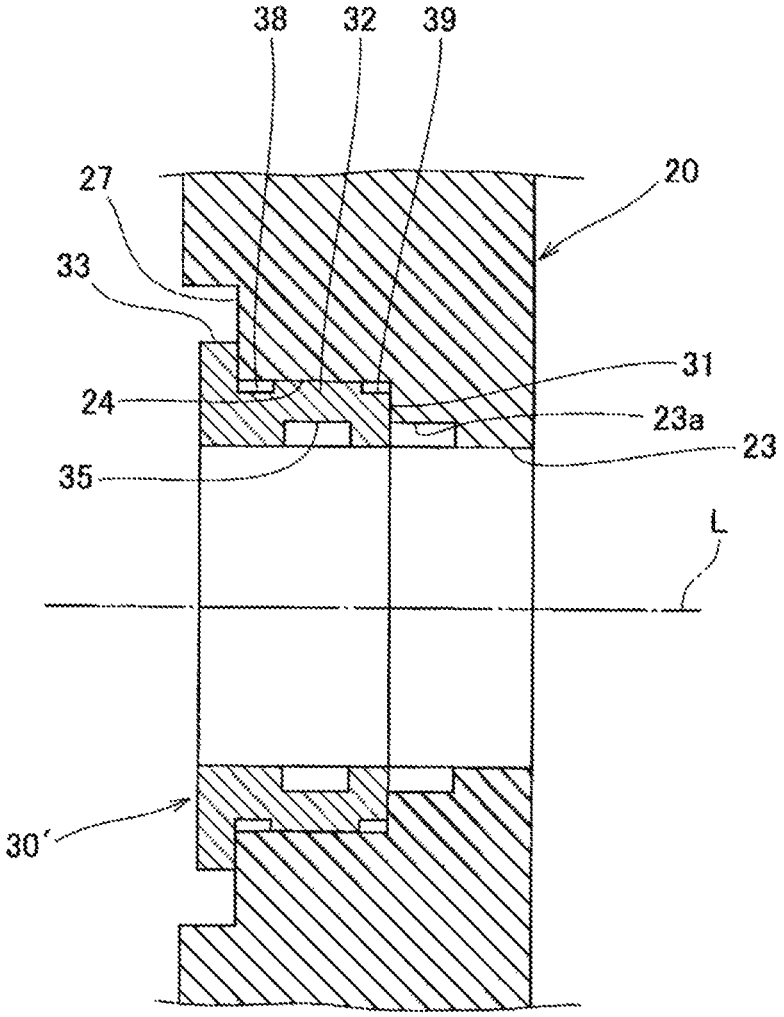
FIG. 15 is a sectional view illustrating another embodiment of a rotor sleeve which is integrally incorporated in the rotor body of the vane rotor constituting a part of the valve timing change device of the present invention.

FIG. 15 illustrates another embodiment of a rotor sleeve which is incorporated in the rotor body of the vane rotor constituting a part of the valve timing change device of the present invention. The same reference signs are applied to the same configurations as those of the embodiment described above, and description will be omitted.

A rotor sleeve 30' according to this embodiment includes the ring-shaped end surface 31, the tubular portion 32, the flange portion 33, the positioning hole 34, the delay angle oil passage 35, the three delay angle oil passages 36, the hooking portion 37, and a ring-shaped recess portion 38 and a ring-shaped clearance portion 39 which are formed on the outer circumferential surface of the tubular portion 32.

According to this configuration, when the tubular portion 32 of the rotor sleeve 30' is press-fitted into the large-diameter inner circumferential portion 24 of the rotor body 20, chips or the like generated through scraping are kept and captured in the ring-shaped recess portion 38 or the ring-shaped clearance portion 39, so that the chips can be prevented from scattering in a sliding interface and the like.

Figure 16:
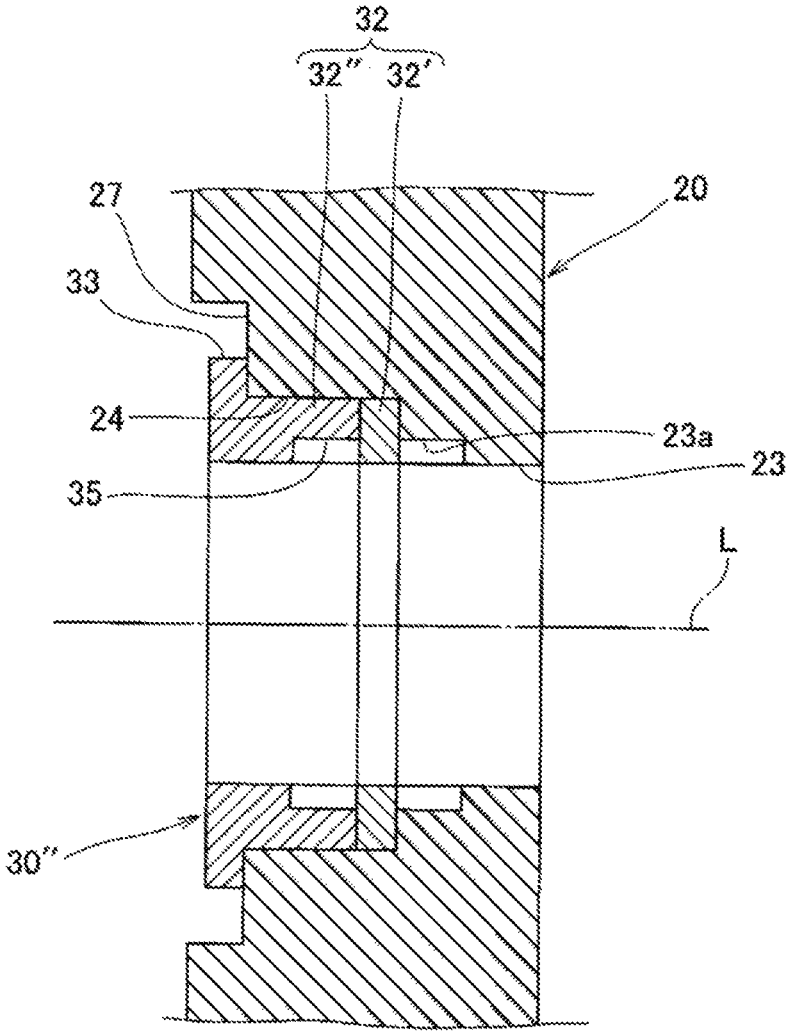
FIG. 16 is a sectional view illustrating further another embodiment of a rotor sleeve which is integrally incorporated in the rotor body of the vane rotor constituting a part of the valve timing change device of the present invention.

FIG. 16 illustrates further another embodiment of a rotor sleeve which is incorporated in the rotor body of the vane rotor constituting a part of the valve timing change device of the present invention. The same reference signs are applied to the same configurations as those of the embodiment described above, and description will be omitted.

A rotor sleeve 30" according to this embodiment includes the ring-shaped end surface 31, the tubular portion 32, the flange portion 33, the positioning hole 34, the delay angle oil passage 35, the three delay angle oil passages 36, the hooking portion 37, and the like.

Here, the tubular portion 32 is constituted of a first tubular portion 32' and a second tubular portion 32", which are formed to be divided into two parts to demarcate the delay angle oil passage 35 constituting a ring-shaped groove in cooperation with each other.

According to this configuration, the tubular portion 32 of the rotor sleeve 30" is configured to be divided into two parts, such that both are assembled to demarcate the delay angle oil passage 35 constituting a ring-shaped groove in cooperation with each other.

Therefore, there is no need to perform boring for constituting a ring-shaped groove with respect to the rotor sleeve 30" as well, labor for processing can be further reduced, and productivity in its entirety can be enhanced.

In the embodiment described above, the rotor sleeve 30 which demarcates the delay angle oil passage 35 constituting a ring-shaped groove has been illustrated as a rotor sleeve. However, the configuration is not limited thereto. For example, in a configuration in which a rotor body includes an advance angle oil passage constituting a ring-shaped groove and a delay angle oil passage constituting a ring-shaped groove, a simply ring-shaped rotor sleeve embedded between the advance angle oil passage and the delay angle oil passage may be employed.

In the embodiment described above, a configuration in which the rotor body 20 demarcates the advance angle oil passage 23*a* as one of the advance angle oil passage and the delay angle oil passage, and the rotor sleeve 30 demarcates the delay angle oil passage 35 as the other of the advance angle oil passage and the delay angle oil passage has been described. However, the configuration is not limited thereto. For example, a configuration in which the rotor body demarcates a delay angle oil passage as one of the advance angle oil passage and the delay angle oil passage, and the rotor sleeve demarcates the advance angle oil passage as the other of the advance angle oil passage and the delay angle oil passage may be employed.

In the embodiment described above, the housing rotor 10 including the sprocket 11*a* which transmits rotation force of the crank shaft has been illustrated. However, the configuration is not limited thereto. For example, if means for transmitting rotary drive force of the crank shaft constitutes a different structure (for example, a toothed timing belt), it is possible to employ a housing rotor including an element (toothed pulley or the like) suitable for the structure.

In the embodiment described above, a configuration including the lock pin 71, the urging spring 72, and the cylindrical holder 73 and being locked at the maximum delay angle position has been illustrated as the lock mechanism. However, the configuration is not limited thereto. For example, the configuration need only be able to lock the vane rotor (20 and 30) with respect to the housing rotor 10, and a different lock mechanism may be employed. In addition, the lock position is not limited to the maximum delay angle position and may be a different position as necessary.

As described above, in the valve timing change device of the present invention, oil leakage or the like from a gap between assembled components generated due to thermal deformation or the like can be prevented and an expected function can be guaranteed. Therefore, the valve timing change device can be naturally applied to internal combustion engines mounted in automobiles, and is also useful for small-sized engines and the like mounted in two-wheeled vehicles and the like.

REFERENCE SIGNS LIST

S Cam shaft
P Positioning pin (common positioning portion)
L Axis
10 Housing rotor
10*a* Advance angle chamber
10*b* Delay angle chamber
20 Rotor body (vane rotor)
23 Small-diameter inner circumferential portion
23*a* Advance angle oil passage (ring-shaped groove)
24 Large-diameter inner circumferential portion
25 Advance angle oil passage
26 Delay angle oil passage
27 Opening end surface
30, 30', 30" Rotor sleeve (vane rotor)
31 Ring-shaped end surface
32 Tubular portion
33 Flange portion
34 Positioning hole (positioning portion)
35 Delay angle oil passage (ring-shaped groove)
36 Delay angle oil passage
37 Hooking portion
38 Ring-shaped recess portion
39 Ring-shaped clearance portion
40 Fastening bolt
45, 46, 47 Oil passage
48 Ring-shaped groove
49 Positioning portion
50 Urging spring

The invention claimed is:

1. A valve timing change device which changes an opening/closing timing of an intake valve or an exhaust valve driven by a cam shaft, the valve timing change device comprising:

a housing rotor that rotates on an axis of the cam shaft;

a vane rotor that demarcates an advance angle chamber and a delay angle chamber in cooperation with the housing rotor and rotates on the axis;

a fastening bolt that fastens the vane rotor such that the vane rotor rotates integrally with the cam shaft, and has oil passages; and an advance angle oil passage that constitutes a ring-shaped groove communicating with the advance angle chamber and a delay angle oil passage that constitutes a ring-shaped groove communicating with the delay angle chamber, via oil passages which are open at intervals on an outer circumferential surface of the fastening bolt, wherein the vane rotor includes a rotor body which has a small-diameter inner circumferential portion coming into contact with the outer circumferential surface of the fastening bolt, and a large-diameter inner circumferential portion being formed to have a larger diameter than the small-diameter inner circumferential portion; and a rotor sleeve which is not in contact with the cam shaft, is fitted into the large-diameter inner circumferential portion, is in contact with the outer circumferential surface of the fastening bolt, and demarcates one of the advance angle oil passage and the delay angle oil passage in cooperation with the small-diameter inner circumferential portion, wherein the rotor sleeve includes a ring-shaped end surface which demarcates one of the advance angle oil passage and the delay angle oil passage in cooperation with the small-diameter inner circumferential portion, and a tubular portion which is press-fitted into the large-diameter inner circumferential portion and demarcates the other of the advance angle oil passage and the delay angle oil passage.

2. The valve timing change device according to claim 1, wherein the tubular portion of the rotor sleeve is formed to be divided into two parts, which demarcate the other of the advance angle oil passage and the delay angle oil passage in cooperation with each other.

3. The valve timing change device according to claim 2, wherein the rotor sleeve includes a flange portion which abuts on an opening end surface of the large-diameter inner circumferential portion and is pressed in an axis direction by the fastening bolt.

4. The valve timing change device according to claim 3, further comprising:

an urging spring that rotatively urges the vane rotor in one direction about the axis with respect to the housing rotor, wherein the rotor sleeve has a hooking portion in the flange portion in which one end portion of the urging spring is hooked.

5. The valve timing change device according to claim 1, wherein the rotor sleeve includes a flange portion which abuts on an opening end surface of the large-diameter inner circumferential portion and is pressed in an axis direction by the fastening bolt.

6. The valve timing change device according to claim 5, further comprising:

an urging spring that rotatively urges the vane rotor in one direction about the axis with respect to the housing rotor, wherein the rotor sleeve has a hooking portion in the flange portion in which one end portion of the urging spring is hooked.

7. The valve timing change device according to claim 1, wherein a ring-shaped recess portion or a ring-shaped clearance portion is formed on an outer circumferential surface in the tubular portion of the rotor sleeve.

8. The valve timing change device according to claim 1, wherein the rotor sleeve and the rotor body are subjected to positioning by a common positioning pin which performs positioning of an angular position about the axis with respect to the cam shaft.

* * * * *